United States Patent [19]

Takauji

[11] Patent Number: 4,991,485

[45] Date of Patent: Feb. 12, 1991

[54] SCALING OF EACH HARMONIC COEFFICIENT FOR ELECTRONIC MUSICAL INSTRUMENT

[75] Inventor: Kiyomi Takauji, Shizuoka, Japan

[73] Assignee: Kabushiki Kaisha Kawai Gakki Seisakusho, Shizuoko, Japan

[21] Appl. No.: 290,860

[22] Filed: Dec. 28, 1988

Related U.S. Application Data

[63] Continuation of Ser. No. 75,605, Jul. 20, 1987, abandoned, which is a continuation-in-part of Ser. No. 847,426, Apr. 2, 1986, Pat. No. 4,700,603.

[30] Foreign Application Priority Data

Sep. 2, 1986 [JP] Japan ..... 61-206492

[51] Int. Cl.[5] ..... G10H 1/057; G10H 1/08; G10H 7/10

[52] U.S. Cl. ..... 84/608; 84/625; 84/626; 84/627

[58] Field of Search ..... 84/1.01, 1.1, 1.13, 84/1.19, 1.21, 1.22, 1.23, 1.24, 1.26, 1.28, 608, 622–627

[56] References Cited

U.S. PATENT DOCUMENTS

| | | | |
|---|---|---|---|
| Re. 31,653 | 8/1984 | Takeuchi | 84/1.21 |
| 4,077,294 | 3/1978 | Hiyoshi et al. | 84/1.23 |
| 4,114,497 | 9/1979 | Hiyoshi et al. | 84/1.19 X |
| 4,176,577 | 12/1979 | Yamada et al. | 84/1.19 X |
| 4,231,276 | 11/1980 | Ando et al. | 84/1.24 X |
| 4,256,004 | 3/1981 | Takeuchi | 84/1.22 X |
| 4,333,377 | 6/1982 | Niezgoda et al. | 84/1.1 X |
| 4,552,051 | 11/1985 | Takeuchi | 84/1.1 X |
| 4,628,785 | 12/1986 | Buchla | 84/1.1 |

*Primary Examiner*—Stanley J. Witkowski
*Attorney, Agent, or Firm*—McGlew & Tuttle

[57] ABSTRACT

A method of scaling a harmonic coefficient is employed, and envelope smaller in number than the number of harmonic orders are produced. One of the envelope is selected for each harmonic order and output as a scaling value. This enables the production of a musical tone imitative of a desired one, decreases the number of envelope generators needed, and permits simplification of the entire system configuration and signal processing.

4 Claims, 7 Drawing Sheets

SCALING OF EACH HARMONIC COEFFICIENT FOR ELECTRONIC MUSICAL INSTRUMENT

CROSS REFERENCE TO RELATED APPLICATION

This is a file wrapper continuation (37 CFR 1.62) of application Ser. No. 075,605 filed July 20, 1987, now abandoned, which in turn is a continuation-in-part of U.S. application Ser. No. 847,426, filed Apr. 2, 1986, which matured into U.S. Pat. No. 4,700,603 on Oct. 20, 1987, entitled "Formant Filter Generator for an Electronic Musical Instrument" and is assigned to the same assignee of the present application.

BACKGROUND OF THE INVENTION

1. Field of the Invention

The present invention relates to an electronic musical instrument which permits easy control of harmonic coefficients in the production of a desired musical waveform by combining harmonic components while at the same time effecting level control of respective harmonic coefficients.

2. Description of the Prior Art

Heretofore there has been widely employed an electronic musical instrument which is of the type that creates a desired musical waveform through a Fourier synthesis computation based on harmonic coefficients.

Conventionally, two methods can be used for scaling the harmonic coefficients, i.e. for controlling their levels. A first method is one that varies a formant filter characteristic in terms of time, and the second method is one that employs envelope generators of the same number as that of harmonic orders involved and scales the harmonic coefficients with envelopes generated corresponding thereto. The first method is capable of providing a general feature of the desired musical waveform because it controls tone components as an overall combination thereof, but this method is unsatisfactory in some aspect. This method is suited to the production of musical tones which match features of the formant filter characteristic, but is not suitable for other musical tones, for example, those which have a certain harmonic component emphasized in particular. On the other hand, according to the second method, since the harmonic components are each controlled, the composite waveform into which they are combined is sufficiently imitative of the desired tone. However, this method is very uneconomical because it calls for the provision of envelope generators for controlling the respective harmonic components, which will inevitably make the system configuration bulky and complex and involve time-consuming control and processing operations.

DESCRIPTION OF DEVICE OF PRIOR APPLICATION Ser. No. 847,426 NOW U.S. Pat. No. 4,700,603

FIGS. 4A and 4B show a system which performs a Fourier synthesis computation based on the harmonic coefficients according to the inventor's prior U.S. patent application Ser. No. 847,426 entitled now U.S. Pat. No. 4,700,603 "Formant Filter Generator for an Electronic Musical Instrument". This system utilizes the formant filter characteristic for scaling the harmonic coefficients.

In FIGS. 4A and 4B a musical tone generating system 100 produces a desired musical tone through use of an ordinary Fourier synthesis system. A key tablet assignor 102 scans a key tablet switch group 101 to detect the ON/OFF state, touch response, or similar information of key switches included in the group 101 and holds the information of the respective switches. The information is provided to a control circuit 103 which controls the system 100.

When supplied with the information from the key tablet assignor 102, the control circuit 103 sets a composite waveform in a main memory 110 on the basis of the following Fourier synthesis equation (1):

$$Zn = \sum_{q=1}^{W} Fq \cdot Cq \cdot \sin \frac{2\pi nq}{2W}, \text{ where } n = 1 \text{ to } 2W. \quad (1)$$

In the above, q is the harmonic order, n the sample point number, W the number of harmonics, Cq a q-order harmonic coefficient, Fq a q-order scaling coefficient, and Zn a sample value. The procedure for the above operation is as follows: A signal is applied from the control circuit 103 to a harmonic coefficient memory 108 to read out therefrom the harmonic coefficient Cq of a timbre desire to be produced. On the other hand, ADSR data which is envelope information representing temporal variations of an envelope, touch response information representing initial and after touch response data, and timbre information representing a selected timbre are applied to a scaling value generator 105, from which is obtained the scaling value Fq for controlling the level of the harmonic coefficient corresponding to the harmonic order q. The harmonic coefficient Cq and the scaling value Fq are multiplied in a multiplier 107, obtaining a harmonic coefficient Cq' scaled by the scaling value Fq. The harmonic coefficient Cq' thus obtained and a q-order sine wave value, $$\sin \frac{\pi nq}{W},$$

read out of a sine wave function table 104 with a signal from the control circuit 103 are multiplied in a multiplier 106. The multiplied value from the multiplier 106 is accumulated by an accumulator 109, by which the composite waveform expressed by Eq. (1) is created and stored in the main memory 110.

Next, the composite waveform thus stored in the main memory 110 is transferred via a transfer select circuit 111 to at least one of note memories **112-*l* to 112-*m* (where m means the Provision of plural note memories, but it is evident that they can be combined into one through use of time-sharing techniques) corresponding to keys. The composite waveform thus stored in the note memory is read out therefrom, without exerting any influence upon the composite waveform, by note frequency data from a note frequency data generator 113 which generates note frequency data corresponding to a depressed key. Data read out of the note frequency memories 112-*l* to 112-*m* corresponding to a note scale is each multiplied, in one of multipliers 114-*l* to 114-*m*, by the envelope output waveform from an envelope generator 115 which creates an envelope waveform corresponding to each depressed key, thus producing musical waveform data added with an envelope. The musical waveform data from the multipliers 114-*l* to 114-*m* is converted by D/A converters 116-*l* to 116-*m* into an analog musical waveform, which is applied to a sound system 117**, creating a desired musical tone.

The principal part of the above-mentioned inventor's prior U.S. patent application described above resides in the scaling value generator 105. The scaling value generator 105 sets the harmonic order q, the cutoff harmonic order $q_c$, and the formant filter level Ha necessary for forming the waveform, on the bases of the ADSR data, the touch response information, and the timbre information, thereby obtaining a desired formant filter characteristic.

However, since control of the harmonic coefficients through use of such a formant filter characteristic is not always suitable for presenting features of musical tones as referred to previously, the inventor has devised a system which utilizes the afore-mentioned second method capable of faithfully presenting features of musical tones but has a simple system configuration.

Close observation of a temporal variation or envelope of each harmonic forming a musical tone shows that there exist several harmonics which undergo similar temporal variations. According to the present invention, envelopes smaller in number than the number of harmonic orders are generated by grouping the harmonics according to their temporal variations. The envelopes are each selected for one of the harmonic orders and the selected envelope is used as the scaling value of the corresponding harmonic which is applied to a sound system 117, creating a desired musical tone.

SUMMARY OF THE INVENTION

It is therefore an obJect of the present invention to provide an electronic musical instrument which has the function of scaling harmonic coefficients, generates envelopes smaller in number than the number of harmonic orders, and utilizes them as scaling values for the harmonic coefficients.

To attain the above obJective, the electronic musical instrument of the present invention, which is of the type that combines harmonic components corresponding to respective harmonic orders into a desired musical waveform while at the same time effecting level control of harmonic coefficients, is provided with envelope generating means for generating envelopes smaller in number than the harmonic orders, means for generating a select code preset corresponding to timbre information for each harmonic order, and means for providing an envelope from the envelope generating means in accordance with the select code provided from the select code generating means.

With the above arrangement, envelopes not greater in number than the number of harmonic orders are produced, and accordingly a common envelope is selected as the scaling value for each group of several harmonic orders. This ensures the production of a musical waveform imitative of that of a desired musical tone and reduces the number of envelope generators needed, which permits simplification of the entire system and control operations.

DESCRIPTION OF THE PREFERRED EMBODIMENTS

Figure 1A:
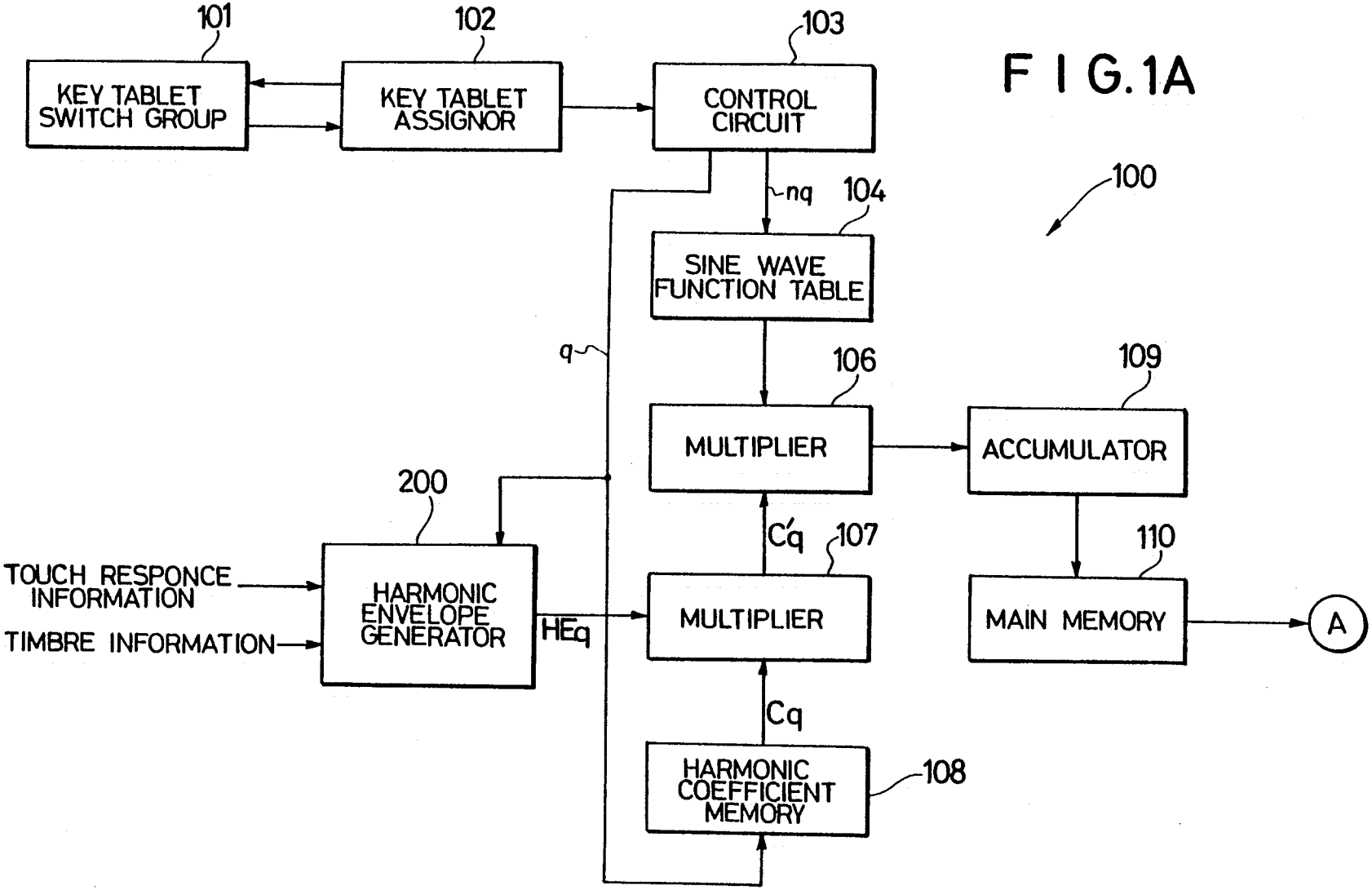
FIGS. 1A and 1B are a block diagram illustrating an embodiment of the present invention.
Figure 1B:
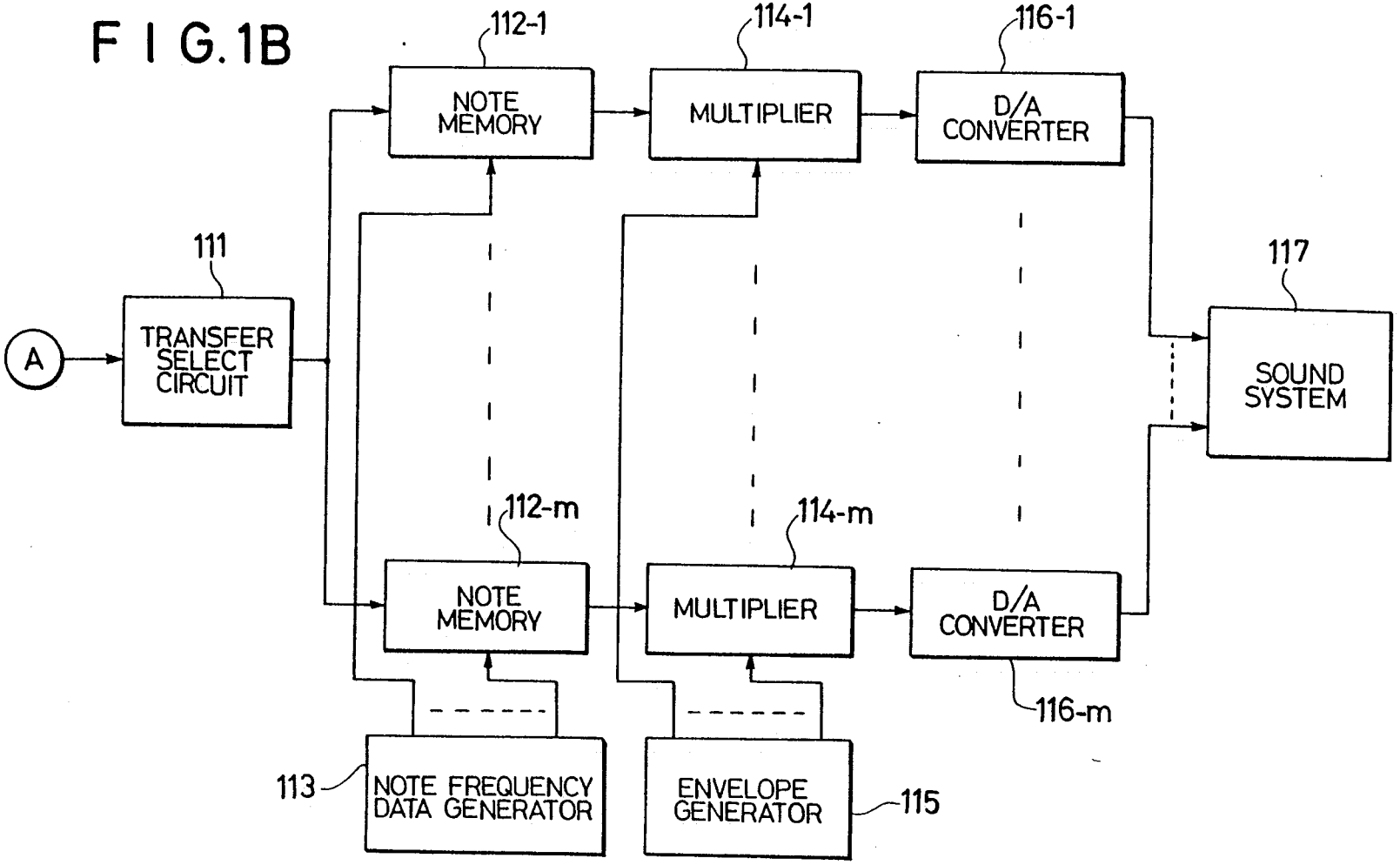
Figure 4A:
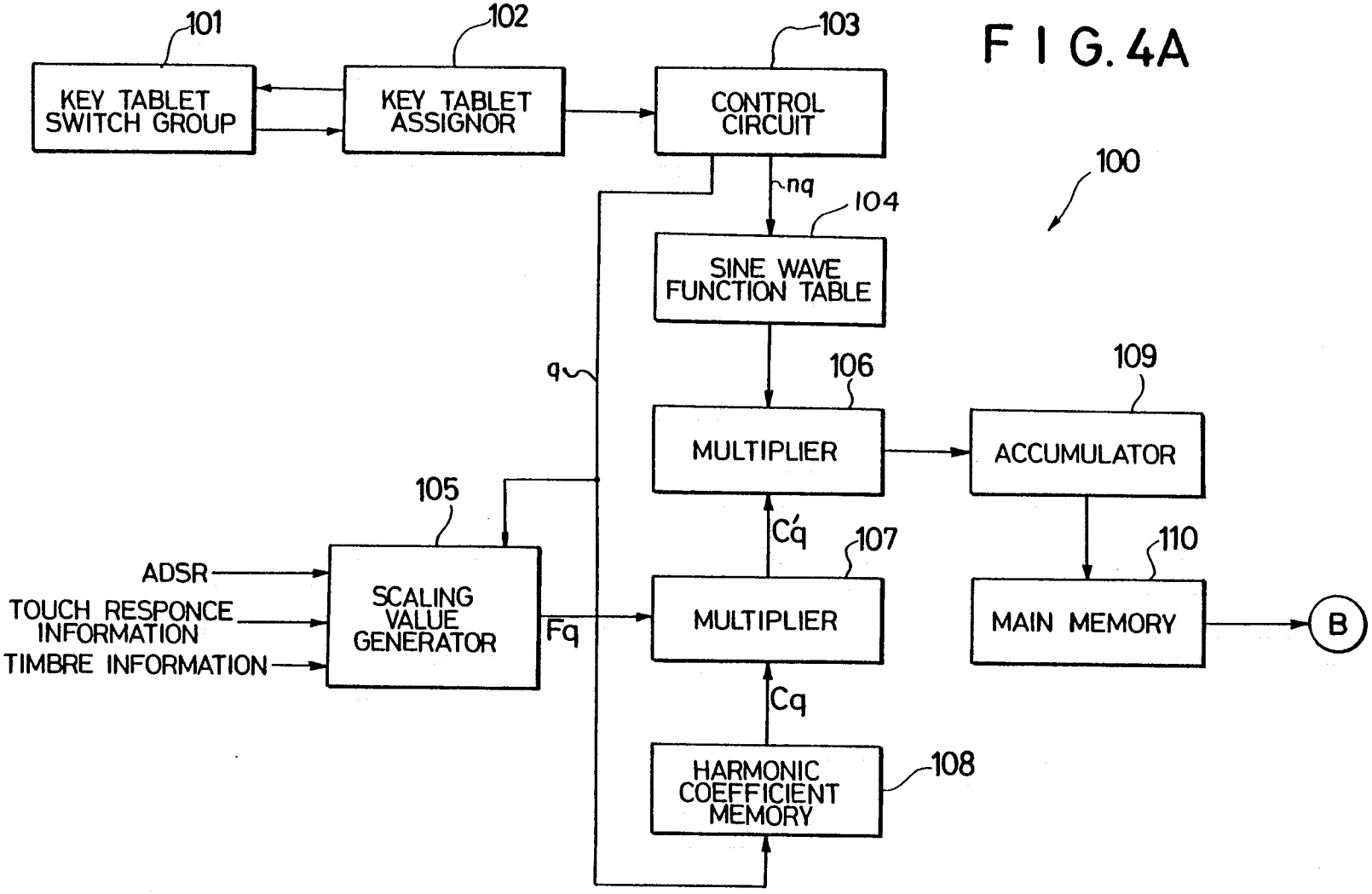
FIGS. 4A and 4B are a block diagram showing example from prior application Ser. No. 847,426.
Figure 4B:
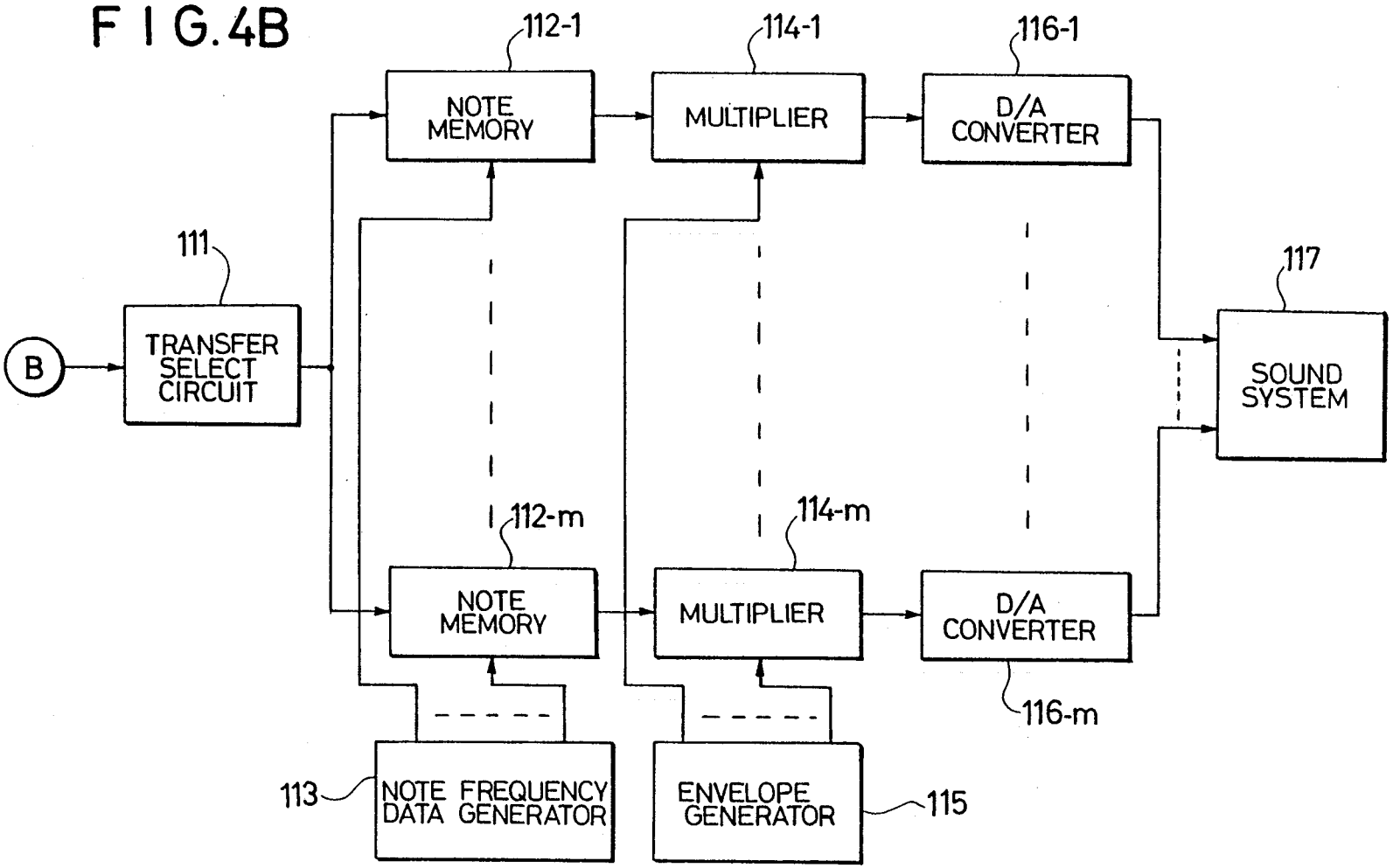

FIGS. 1A and 1B illustrate in block form the arrangement of an embodiment of the present invention. This embodiment differs from the prior art example of FIGS. 4A and 4B in the provision of a harmonic envelope generator 200 which is supplied with harmonic order signal q touch response information and timbre information, in place of the scaling value generator 105. That is, touch response information representing initial and after touch response data and timbre information representing a selected timbre are applied to the harmonic envelope generator 200, which, in turn, provides a harmonic envelope coefficient HEq for scaling the harmonic coefficient Cq. The harmonic coefficient Cq and the harmonic envelope coefficient HEq are multiplied in the multiplier 107, thereby obtaining the harmonic coefficient Cq' scaled by the harmonic envelope coefficient HEq. The subsequent operations are the same as those described previously in connection with FIGS. 4A and 4B.

Figure 2A:
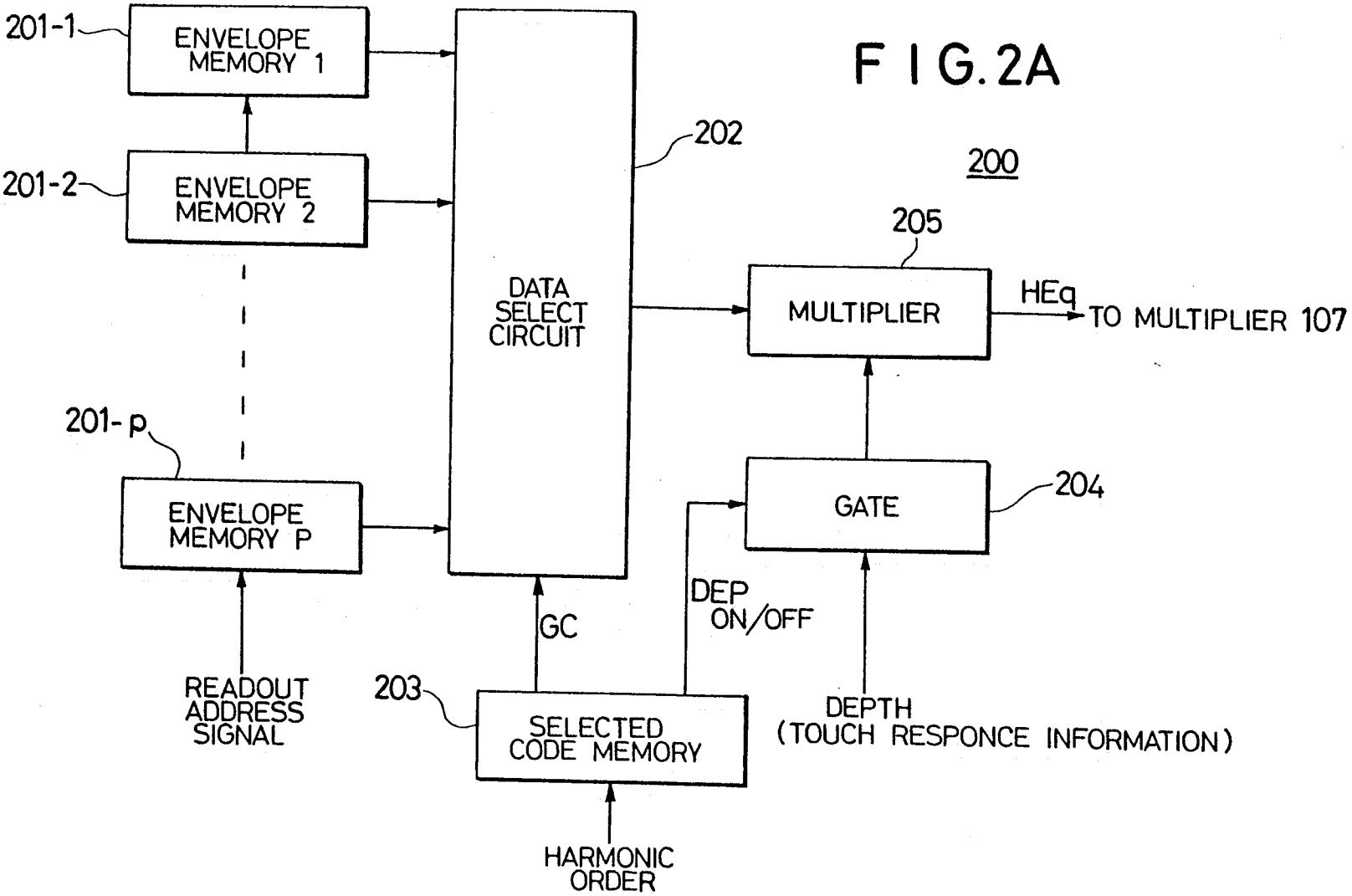
FIGS. 2A to 2C are diagrams for explaining in detail the principal part of the embodiment shown in FIG. 1.
Figure 2B:
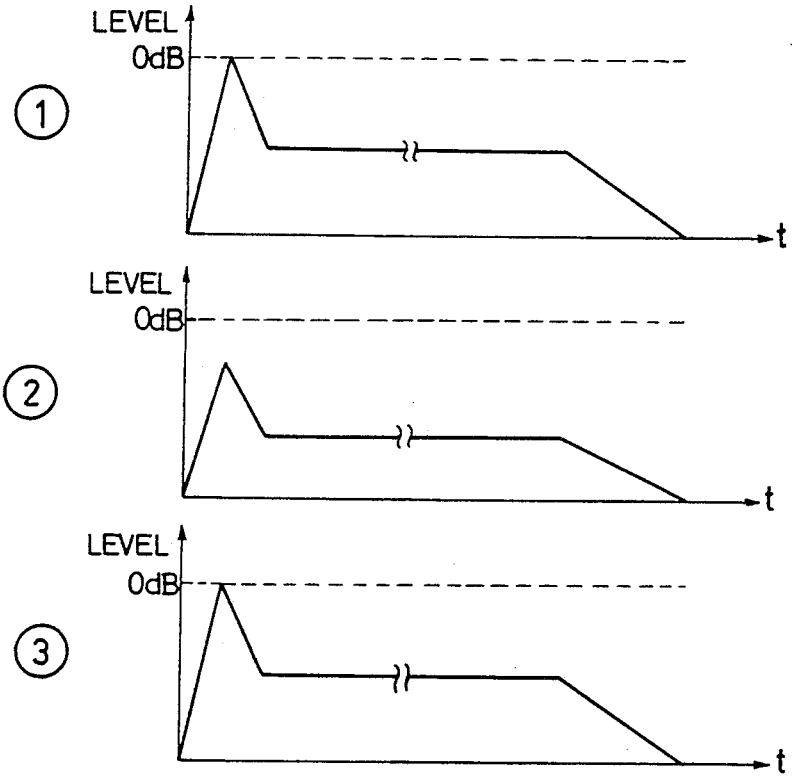
Figure 2C:
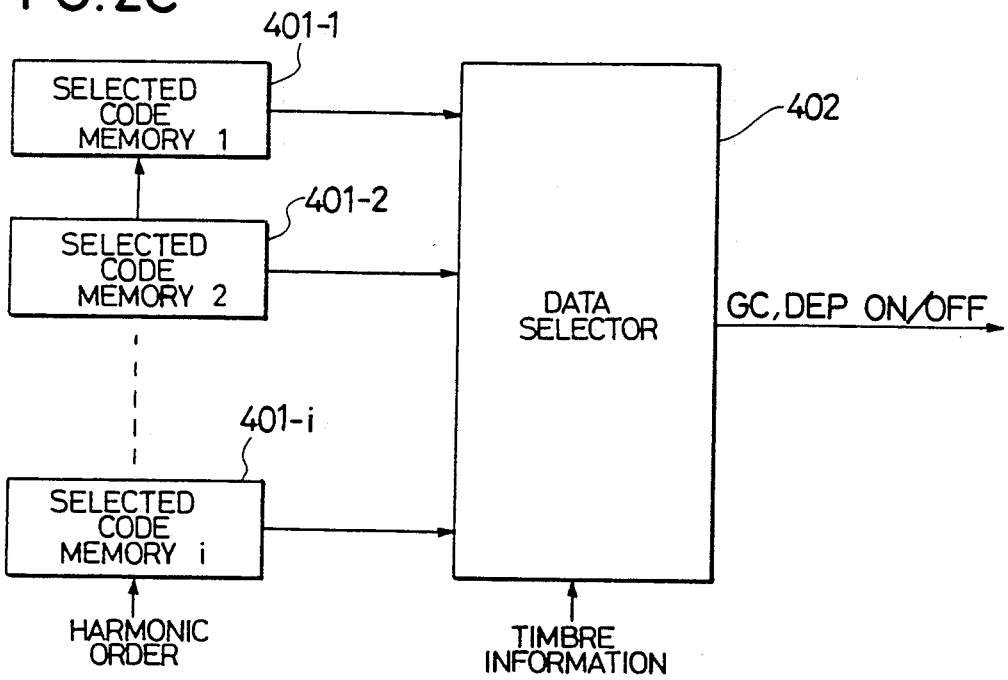

FIGS. 2A through 2C are diagrams for explaining in detail the principal part of the embodiment depicted in FIGS. 1A and 1B.

FIG. 2A illustrates in block form the arrangement of the harmonic envelope generator 200. Envelope memories **201-*l* to 201-*p* are memories from which envelope curves are read out simultaneously by readout address signals which are provided from a readout address signal generator (not shown) in accordance with the varying state of a depressed key in the time interval between its depression and release (in which the readout address starts upon depression of the key, but do not advance during its sustaining, and starts again upon its release). In the above p means that there exist a plurality of envelopes, and the value of p is smaller than the number W of harmonics. The outputs from the envelope memories 201-*l* to 201-*p* are provided to a data select circuit 202. On the basis of a group code signal (GC) which is read out from a select code memory 203, using the harmonic order q as a readout address therefor, the data select circuit 202 selects and applies one of the outputs from the envelope memories 201-*l* to 201-*n* to the one input of a multiplier 205, to the other input of which is applied the output from a gate 204. The gate 204 is supplied with a DEPTH signal for scaling in the multiplier 205 the envelope selected by the data select circuit 202 and a DEP ON/OFF signal from the select code memory 203, and the gate 204 gates the former by the latter. That is, when the DEP ON/OFF signal is ON, the selected envelope curve becomes an envelope curve of a quantity scaled by the DEPTH signal, and when the DEP ON/OFF signal is OFF, the selected envelope curve remains unchanged, without being scaled by the DEPTH signal. This is shown in FIG. 2B. FIG. 2B shows the envelope curve selected by the data select circuit 202, and FIGS. 2B and show that the output level of the multiplier 205, i.e. the envelope level differs depending upon whether the DEP ON/OFF signal is ON or OFF. Furthermore, it is possible to control a desired envelope with touch response information, by deriving the DEPTH signal from the touch response information of a key being depressed, for instance. This means that each harmonic coefficient Cq is scaled, in the multiplier 107 in FIG. 1, by the harmonic envelope signal HEq from the multiplier 205**; in consequence, the desired harmonic coefficient Cq can be scaled by the touch response information of the key being depressed.

While only one select code memory 203 is shown in FIG. 2A, it is also possible to employ an arrangement in which a plurality of select code memories 401-*l* to 401-*i* are provided and one of their outputs is selected by a data selector 402 in accordance with timbre information of a selected tablet, generating the signal for selecting an envelope, as shown in FIG. 2C. Although in FIG. 2A the select code memory 203 is shown to be a fixed memory, it may also be a random access memory; in such a case, by providing a means for rewriting the contents of the memory 203 in accordance with timbre information of a selected tablet, the envelope select code (GC) corresponding to the timbre information and the DEP ON/OFF signal for gating the DEPTH signal can be produced. In other words, it is possible to select an envelope and an envelope level corresponding to a selected timbre.

Figure 3:
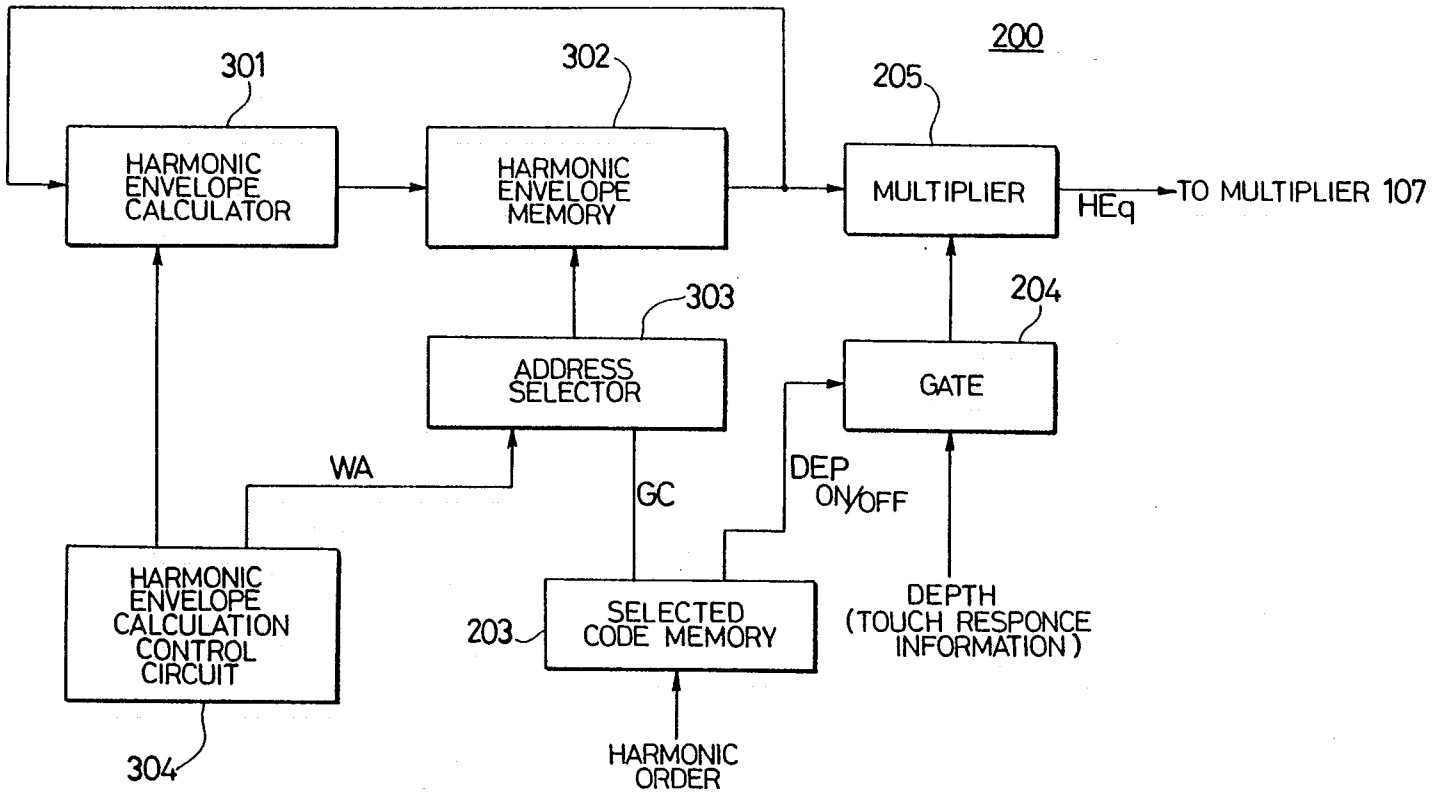
FIG. 3 is a block diagram illustrating another example of the principal part of the embodiment.

FIG. 3 illustrates in block form another example of the circuit arrangement of the harmonic envelope generator 200. A harmonic envelope calculator 301 responds to a control signal from a harmonic envelope calculation control circuit 304 to calculate amplitude values of a plurality p of envelopes which vary with time in the interval between the depression of a key and its release. The envelope amplitude values thus obtained are stored in a harmonic envelope memory 302. The areas of the harmonic envelope memory 302 in which the envelope amplitude values are stored are indicated by address signals WA from the harmonic envelope caluculation control circuit 304 which are supplied via an address selector 303. In this case, $0 \leqq WA \leqq p-1$ (on the assumption that the storage areas start at an address "0"). The envelope amplitude values stored in the harmonic envelope memory 302 are each read out therefrom in the same manner as described previously with repect to FIG. 2A, and they are each multiplied by the DEPTH signal, thereafter being provided to the multiplier 107 shown in FIG. 1.

As will be appreciated from the description given of FIGS. 2A and 3, the present invention produces envelopes smaller in number than the number of harmonic orders, selects a desired one of the envelopes for each harmonic order, and utilizes it as a scaling value for scaling the corresponding harmonic coefficient.

As described above, the present invention employs the method of scaling harmonic coefficients, creates envelopes smaller in number than the number of harmonic orders, and selects and outputs, as a scaling value, one of the envelopes for each harmonic order. This enables the production of a musical tone imitative of a desired one, decreases the number of envelope generators used, and hence permits simplification of the system configuration and signal processing.

It will be apparent that many modifications and variations may be effected without departing from the scope of the novel concepts of the present invention.

What is claimed is:

1. An electronic musical instrument which synthesizes a musical wave form by harmonics through use of W harmonic coefficients, wherein means for controlling each of said W harmonic coefficients comprises:

harmonic coefficient storage means for storing said W harmonic coefficients which constitute the basis for the production of said musical wave form;

harmonic order generating means for generating a harmonic order signal, said harmonic order signal for specifying each of said W harmonic coefficients;

grouping code storage means for dividing a number of said W harmonic coefficients into P groups (where P is smaller than W) of a number smaller than the number of harmonic coefficients, in accordance with timbre information, and for storing a grouping code for each harmonic order;

harmonic envelope generating means for generating P harmonic envelopes;

harmonic coefficient read out means responsive to said harmonic order signal for reading out the corresponding one of said harmonic coefficients from said harmonic coefficient storage means;

grouping code read out means responsive to said harmonic order signal for reading out said grouping code stored in said grouping code storage means for each harmonic order; and selecting means responsive to said grouping code, for selecting from said harmonic envelope generating means one of said P harmonic envelopes which corresponds to said each harmonic order;

wherein each harmonic coefficient corresponding to each harmonic order signal, read out of said harmonic coefficient storage means, is controlled by said selected harmonic envelope corresponding to said each harmonic order signal.

2. The electronic musical instrument of claim 1 wherein said harmonic envelope generating means comprises: storage means for storing amplitude values of said harmonic envelopes; means for reading out said amplitude values of said harmonic envelopes from said storage means and calculating new amplitude values of said harmonic envelopes; means for storing said new amplitude values of said harmonic envelopes into said storage means; and means for supplying said grouping code as an address for accessing said storage means to select said harmonic envelope corresponding to said each harmonic order.

3. An electronic musical instrument which synthesizes a musical wave form by harmonics through use of W harmonic coefficients, wherein means for controlling each of said W harmonic coefficients comprises:

harmonic coefficient storage means for storing said W harmonic coefficients which constitute the basis for the production of said musical wave form;

harmonic order generating means for generating a harmonic order signal, said harmonic order signal for specifying each of said W harmonic coefficients;

grouping code storage means for dividing said W harmonic coefficients into P groups (where P is smaller than W) of a number smaller than the number of harmonic coefficients themselves, in accordance with timbre information, and which stores a grouping code for each harmonic order;

harmonic envelope generating means for generating P harmonic envelopes;

scaling value generation means for generating a scaling value for scaling said harmonic envelopes;

scaling ON/OFF information storage means for storing, for each harmonic order, harmonic envelope scaling ON/OFF information which controls and specifies, in accordance with said timbre information, whether or not said harmonic envelopes are scaled by said scaling value;

harmonic coefficient read out means responsive to said harmonic order for reading out the corresponding one of said harmonic coefficients from said harmonic coefficient storage means;

grouping code read out means responsive to said harmonic order signal for reading out said grouping code stored in grouping code storage means for each harmonic order;

selecting means responsive to said grouping code for selecting from said harmonic envelope generating means one of said P harmonic envelopes which corresponds to said each harmonic order;

scaling read out means responsive to said harmonic order signal for reading out said envelope scaling ON/OFF information corresponding to said harmonic order; and multiplying means responsive to said envelope scaling ON/OFF information for multiplying said scaling value and said harmonic envelope selected; wherein said harmonic coefficient corresponding to said harmonic order, is controlled by said harmonic envelope corresponding to said harmonic order, output from said multiplying means.

4. The electronic musical instrument of claim 3 further comprising a keyboard having a plurality of keys; assign means including a touch response information generator which scans said plurality of keys of said keyboard, assigns a depressed key, detects the speed of depression of said assigned key, and generates touch response information corresponding to said detected speed, and an after touch response information generator which detects the pressure of depression of said depressed key and generates after touch information corresponding to said detected pressure; and means for varying said scaling value in accordance with said touch response information and said after touch response information; wherein only a harmonic coefficient specified by said scaling ON/OFF information is varied by said varied scaling value in accordance with said touch response information and said after touch response information.

* * * * *